US005924558A

United States Patent [19]

De Mayo

[11] Patent Number: 5,924,558

[45] Date of Patent: Jul. 20, 1999

[54] FOLDING EYEGLASS CASE

[76] Inventor: Edward N. De Mayo, 7 Stewart Rd., San Rafael, Calif. 94901

[21] Appl. No.: 08/905,062

[22] Filed: Aug. 1, 1997

[51] Int. Cl.[6] ..... A45C 11/04; B65D 85/38

[52] U.S. Cl. ..... 206/5; 206/37

[58] Field of Search ..... 206/5, 6, 38, 38.1, 206/37, 234, 286, 287.1; 190/107

[56] References Cited

U.S. PATENT DOCUMENTS

| | | | |
|---|---|---|---|
| D. 351,945 | 11/1994 | Kopel . | |
| 3,850,352 | 11/1974 | Reiner . | |
| 3,994,391 | 11/1976 | Holland . | |
| 4,290,522 | 9/1981 | Takasaki . | |
| 4,418,733 | 12/1983 | Kallman . | |
| 4,899,873 | 2/1990 | Bollé . | |
| 4,951,817 | 8/1990 | Barletta et al. | 206/38 |
| 4,960,208 | 10/1990 | Tempke . | |
| 5,123,525 | 6/1992 | Orlowski | 206/5 |
| 5,299,682 | 4/1994 | Tatar | 206/5 |
| 5,310,048 | 5/1994 | Stechler | 206/5 |
| 5,366,072 | 11/1994 | Goldenberg . | |
| 5,433,362 | 7/1995 | Battaglia . | |
| 5,499,710 | 3/1996 | Hoffman | 206/81 |
| 5,526,924 | 6/1996 | Klutznick . | |
| 5,651,455 | 7/1997 | Garcia | 206/287.1 |
| 5,676,242 | 10/1997 | Scott | 206/6 |

*Primary Examiner*—Paul T. Sewell
*Assistant Examiner*—Luan K. Bui
*Attorney, Agent, or Firm*—Crosby, Heafey, Roach & May

[57] ABSTRACT

A folding eyeglass case has a flexible case with an open end and a closed end. A first closure mechanism is affixed to the case near the open end and a second closure mechanism is affixed to the case near the closed end of the case. The first and second closure mechanisms securely engage with each other when the case is folded in half. Preferably, the first and second closure mechanisms are affixed so as to mate on a first side of the case. The second side of the case includes VELCRO strips or the like for attachment to a belt clip or a pager.

4 Claims, 2 Drawing Sheets

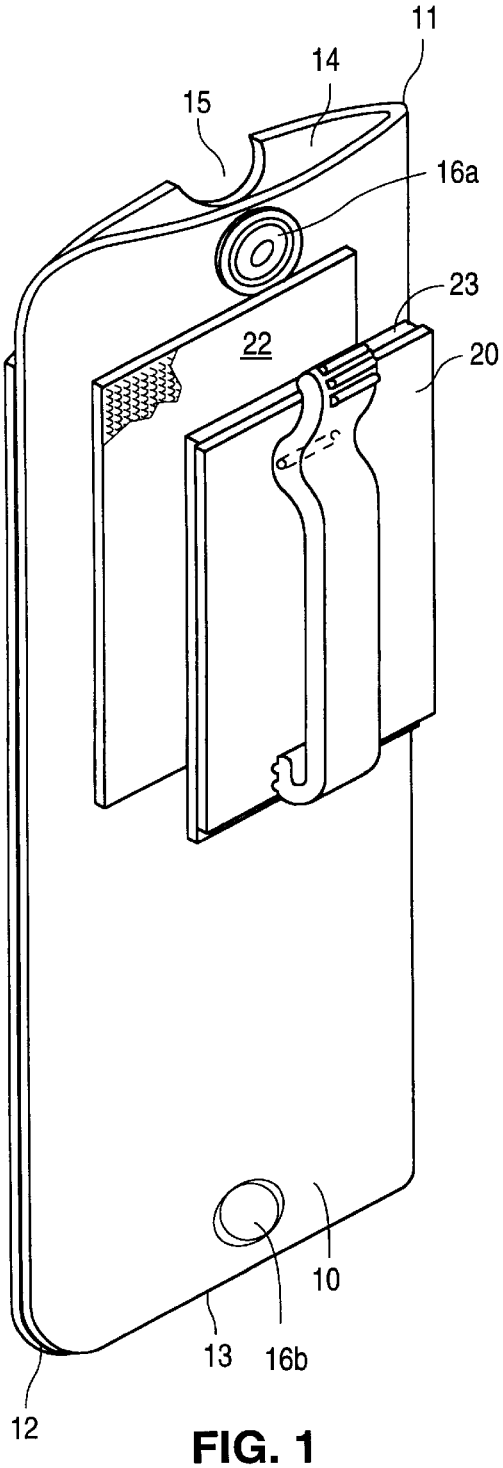
FIG. 1
FIG. 2
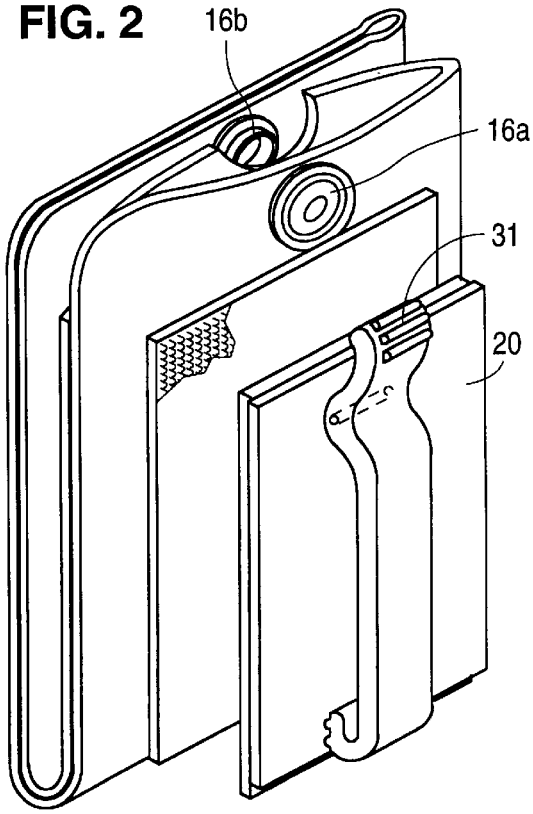
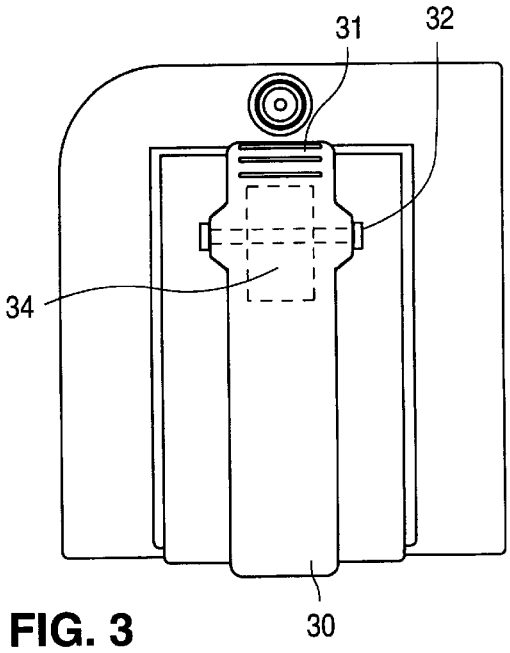
FIG. 3

FOLDING EYEGLASS CASE

BACKGROUND OF THE INVENTION

The present invention relates to a case for holding eyeglasses, and more specifically, to a folding eyeglass case.

Cases for holding eyelasses are generally known and include hard cases and soft cases. Methods for coupling the case to a belt, purse, briefcase or other surface are also known. For example, U.S. Pat. No. 3,994,391 discloses a spectacle case having a clip. U.S. Pat. No. 5,526,924 discloses an eyewear case having straps.

In many cases, an eyeglass case has been combined with other useful articles. For example, U.S. Pat. No. Des. 351,945 discloses a combined wallet and eyeglass case. U.S. Pat. No. 3,850,352 discloses a case for holding glasses and writing implements. U.S. Pat. No. 4,960,208 discloses an eyeglass case including compartments for storing eyewear cleaning equipment and solutions. U.S. Pat. No. 5,366,072 discloses a combined eyeglass storage pouch and neckstrap tensioning device.

It remains desirable to have an eyeglass case which is mobile and easily able to be attached to one's belt or clothing, for example. It would be desirable to have an eyeglass case which could be rendered more compact when not in use for storing glasses. Further, it would be desirable to combine such an eyeglass case with other small belt or clothing attachable devices, for example, an electronic pager.

SUMMARY OF THE INVENTION

The present invention is a folding eyeglass case. In a preferred embodiment, a flexible case has an open end for receiving a pair of glasses into the case and a closed end opposite the open end. A first closure mechanism is affixed to the case proximate to the open end of the case and a second closure mechanism is affixed to the case proximate to the closed end of the case. The first and second closure mechanisms securely engage with each other when the case is folded in half.

In a particularly preferred embodiment, the first and second closure mechanisms are affixed so as to mate on a first side of the case. The second side of the case includes VELCRO strips or other attachment method proximate to the open end for mutual coupling to a similarly equipped belt clip, or advantageously, a small electronic device, such as a pager, having such a belt clip.

A better understanding of the features and advantages of the present invention will be obtained by reference to the following detailed description of the invention and accompanying drawings which set forth an illustrative embodiment in which the principles of the invention are utilized.

BRIEF DESCRIPTION OF THE DRAWINGS

FIG. 1 is a rear perspective view of an eyeglass case according to the present invention.

FIG. 2 is a rear perspective view of the eyeglass case of FIG. 1 which has been folded according to the present invention.

FIG. 3 is a rear plan view of the eyeglass case of FIG. 2.

DETAILED DESCRIPTION OF THE INVENTION

Figure 4:
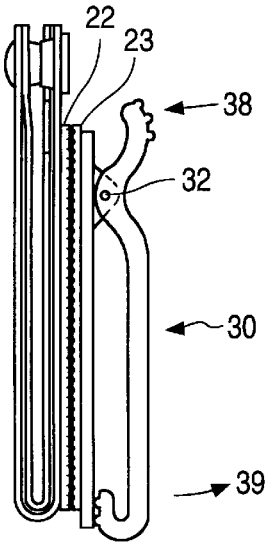
FIG. 4 is a side plan view of the eyeglass case of FIG. 2.

Referring now to FIG. 1, a preferred embodiment of the present invention is illustrated. A flexible case 10 is provided to store a pair of glasses therein. The case 10 may be made from cloth, leather or synthetic material, but should be sufficiently flexible and resilient to withstand repeated folding and unfolding. Therefore, high quality full grain leather is preferred.

The illustrated embodiment includes a single piece of material which is cut to shape, folded over itself at edge 11, then sealed at edge 12, for example, by gluing and stitching. The edge 12 is also sealed at the bottom 13 of the case 10 to provide a closed end, but the top 14 of the case remains open to receive a pair of glasses therein.

A first closure mechanism 16*a* is affixed to the case near the open end 14 and a second closure mechanism 16*b* is affixed to the case near the closed end 13. When the glasses are not stored in the case, the case is folded in half and the closure mechanisms 16*a* and 16*b* are engaged with each other. This permits the case to be very compact and unobtrusive when carried by a person, yet easy to open and use for storage of glasses.

A snap fastener is used in the preferred embodiment, such as that made by Scovill Manufacturing Company, wherein one fastener member has a circular recess and the other fastener member has a circular protrusion which engages the circular recess when the two members are snapped together. However, there are other closure mechanism which would also be suitable for this application.

Obviously, the closure mechanisms must extend from the same side of the case in order to snap together. This can be done by affixing the mechanisms on the same side of the case. However, in the preferred embodiment, closure mechanism 16*a* is affixed on one side of the case 10 and extends through a semicircular opening 15 provided on the other side of the case to mate with closure mechanism 16*b*, as shown in FIG. 2.

Advantageously, a clip 20 is attached to the case 10 for allowing the case to be clipped onto a belt, purse, briefcase, or other semi-rigid surface. In the illustrated embodiment, a first VELCRO strip 22 is affixed to the case 10 and a mating VELCRO strip 23 is affixed to the back of the clip 20, for example, with a suitable adhesive. The use of VELCRO connectors allows the case 10 to be used with a wide variety of personal effects and devices suitably equipped with mating VELCRO strips.

Referring now to FIGS. 3 and 4, the clip 20 includes a lever 30 which rotates about hinge pin 32 when the top end 31 of the lever is pressed in the direction of arrow 38, thereby opening the clip at the bottom in the direction of arrow 39 for attachment to a suitable article. The lever 30 includes a bias spring 34 which biases the lever into a closed position.

Figure 5:
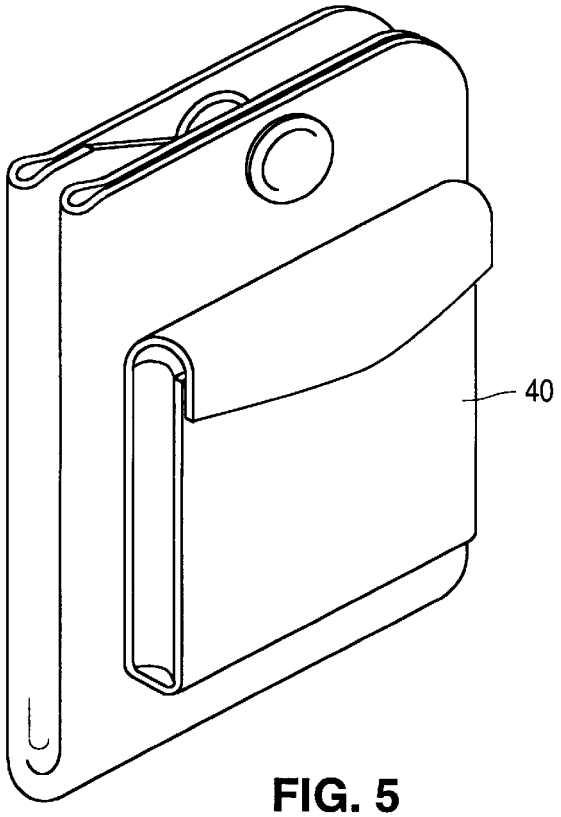
FIG. 5 is a rear perspective view of an alternative embodiment of an eyeglass case according to the present invention.

Referring now to FIG. 5, another embodiment is illustrated wherein a storage compartment 40 is affixed to the case 10, for example, by stitching or suitable adhesive, to store coins, keys, or the like. The storage compartment 40 may be made from cloth, leather or synthetic material and preferably includes a flap 42 which can be closed, for example, with snaps or mating VELCRO strips, to retain the contents in the compartment.

Figure 6:
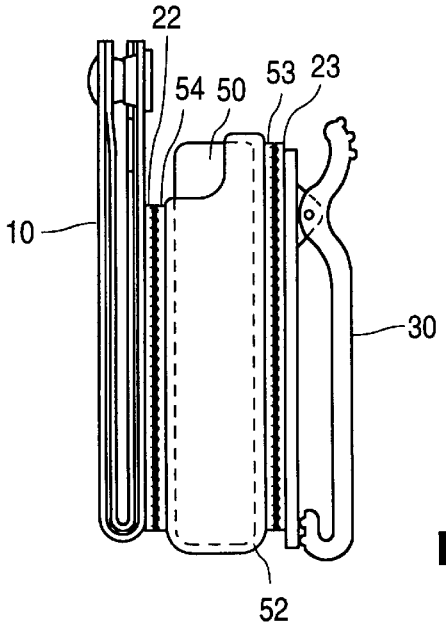
FIG. 6 is a side plan view of another alternative embodiment of an eyeglass case according to the present invention.

Referring now to FIG. 6, the most preferred embodiment of the present invention is illustrated, wherein the case 10 is coupled to a small electronic device 50, such as a standard pager made and sold by Motorola and others. The pager 50 is contained within a case or housing 52 and will typically include a clip 30 as previously described on one side of the housing. For example, the housing 52 can have a VELCRO strip 53 on one side that mates with VELCRO strip 23 on the clip 30, and another VELCRO strip 54 on the other side that mates with VELCRO strip 22 on the case 10. Other means of attachment could also be used, but VELCRO material is relatively easy to apply and inexpensive to use.

It should be understood that the invention is not intended to be limited by the specifics of the above-described embodiment, but rather defined by the accompanying claims.

I claim:

1. A folding eyeglass case, comprising:

a flexible case having two mutually opposing flexible sides each having a generally retangular shape having a length exceeding the width affixed together with an opening extending along the width to define an open end for receiving a pair of glasses into the case and a closed end opposite the open end, a first closure mechanism affixed to the case proximate to the open and of the case, a second closure mechanism affixed to the case proximate to the closed end of the case and adapted to securably couple with the first closure mechanism when the case is folded in half about a line perpendicular to the length of the opposing flexible sides, and wherein the first and second closure mechanisms are affixed so as to mate on a first side of the case, and further comprising first attachment means affixed on a second side of the case proximate to the open end for attaching a small electronic device to the case.

2. The eyeglass case of claim 1, wherein the electronic device includes a housing having opposing sides, a first side of which includes second attachment means for coupling with the first attachment means on the case and a second side of which includes a belt clip.

3. The eyeglass case of claim 1, wherein the electronic device is a pager.

4. A folding eyeglass case, comprising:

a flexible case having two mutually opposing flexible sides each having a generally retangular shape having a length exceeding the width affixed together with an opening extending along the width to define an open end for receiving a pair of glasses into the case and a closed end opposite the open end, a first closure mechanism affixed to the case proximate to the open end of the case, and a second closure mechanism affixed to the case proximate to the closed end of the case and adapted to securably couple with the first closure mechanism when the case is folded in half about a line perpendicular to the length of the opposing flexible sides, first attachment means affixed on a second side of the case proximate to the open end, and a small electronic device having a housing with opposing sides, a first side of which includes second attachment means for coupling with the first attachment means on the case and a second side of which includes a hook suitable for hanging onto a belt.

* * * * *